United States Patent [19]

Schmid

[11] Patent Number: 4,458,429

[45] Date of Patent: Jul. 10, 1984

[54] TONGUE FOR A SHOE, PARTICULARLY A SPORT SHOE, AND A SHOE INCLUDING SUCH A TONGUE

[75] Inventor: Marcel Schmid, Fribourg, Switzerland

[73] Assignee: Sarragan S.A., Fribourg, Switzerland

[21] Appl. No.: 364,860

[22] PCT Filed: Jul. 21, 1981

[86] PCT No.: PCT/CH81/00085

§ 371 Date: Mar. 22, 1982

§ 102(e) Date: Mar. 22, 1982

[30] Foreign Application Priority Data

Jul. 21, 1980 [FR] France ..... 80 16028

[51] Int. Cl.[3] ..... A43B 7/08; A43B 23/26

[52] U.S. Cl. ..... 36/3 A; 36/54

[58] Field of Search ..... 36/3 A, 54, 114, 3 R; 2/DIG. 1

[56] References Cited

U.S. PATENT DOCUMENTS

| | | | |
|---|---|---|---|
| 1,168,166 | 1/1916 | Cook | 36/3 A |
| 1,679,102 | 7/1928 | Thompson | 2/DIG. 1 |
| 2,614,339 | 10/1952 | Herceg | 36/54 |
| 3,284,931 | 11/1966 | Dassler | 36/54 |

*Primary Examiner*—Werner H. Schroeder
*Assistant Examiner*—Steven N. Meyers
*Attorney, Agent, or Firm*—Arnold, White & Durkee

[57] ABSTRACT

A tongue for a shoe, particularly a sport shoe. The tongue has a padded front surface and a multiplicity of orifices (3) passing through this surface. Each of the orifices contains a layer (5) of a porous or reticular material.

9 Claims, 3 Drawing Figures

TONGUE FOR A SHOE, PARTICULARLY A SPORT SHOE, AND A SHOE INCLUDING SUCH A TONGUE

The present invention concerns a tongue for a shoe, particularly a sport shoe.

As a result of the exertion of the user of a shoe, heating an perspiration occur in the zone where the tongue rests on the foot, resulting in discomfort to the user.

The present invention has the purpose of making available a tongue which prevents this problem, while still offering sufficient protection of the corresponding zone of the foot against the pressure of the laces and against possible shocks.

The tongue of this invention is essentially characterized by the fact that it has a padded front surface and a large number of penetrating orifices, each of which contains a layer of a porous or reticular material.

This construction assures good ventilation of the instep during use, as the layer of porous or reticular material does not impede the circulation of air through the orifices and assures the mechanical stability of the tongue, specifically opposing deformations of the tongue or tearing at the orifices.

In a particularly advantageous mode of implementation, the tongue consists of the assembly of a front layer of padded material having a large number of orifices, an intermediate layer of a porous or reticular material such as a small-mesh net of a natural or synthetic material obtained by weaving or extrusion, and a back layer intended to come in contact with the instep, having orifices corresponding to the orifices of the front layer. The tongue is assembled by causing the front layer to adhere to the back layer, along the circumference of the tongue and the circumference of each of the orifices, through the meshes of the intermediate layer, preferably by heat-welding.

It should be noted that with this mode of implementation, the intermediate layer is continuous over practically the totality of the tongue, and is anchored at the orifices and possibly also at the circumference of the tongue, which assures perfect dimensional stability to the tongue, while offering good ventilation capacity due to the large number of orifices distributed over the tongue.

The present invention also has as an object a shoe, particularly a sport shoe having a tongue with the characteristics described above.

In order to give a better understanding of the invention, a mode of implementation will now be described as a non-limiting example. The description refers to the attached drawing in which.

The tongue of this invention has a padded front layer 1 and a back layer 2 which is intended to come in contact with the instep. Each of these outside layers has a multiplicity of perforations, represented by 3 for the front layer and 4 for the back layer. These perforations are of the same dimensions and are positioned so as to be opposite each other when front layer 1 and back layer 2 are applied against one another to form the tongue.

Figure 1:
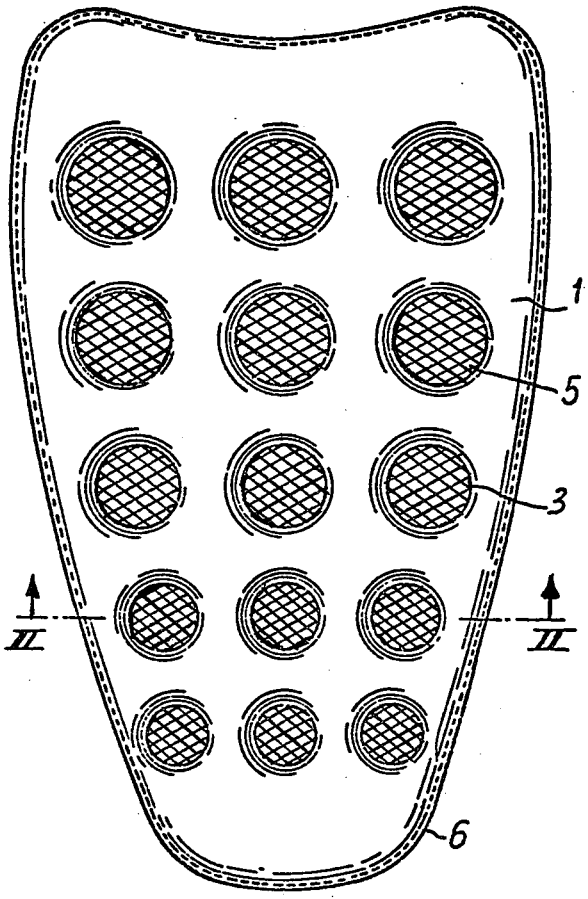
FIG. 1 is a frontal elevation of the tongue of this invention.
Figure 2:
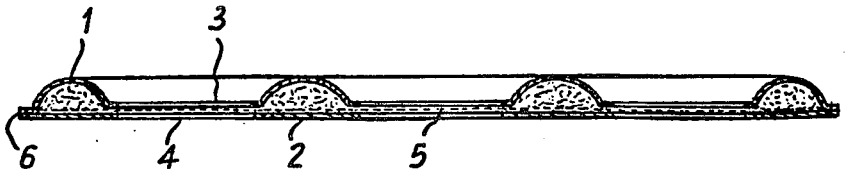
FIG. 2 is a cross sectional view along II—II of FIG. 1.
Figure 3:
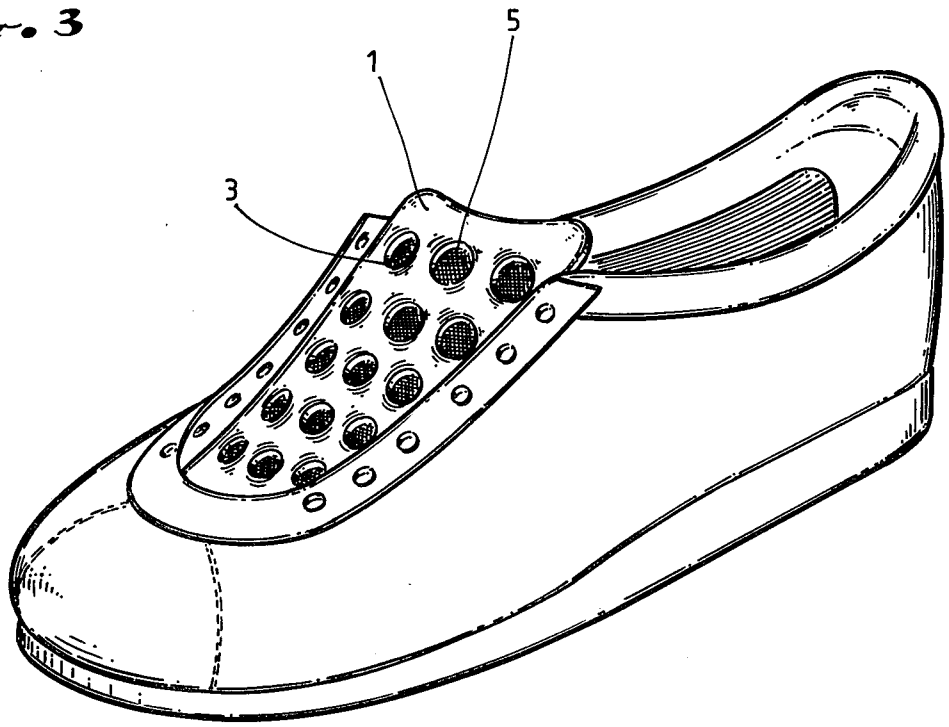
FIG. 3 is a view of the tongue of this invention shown in a typical sport shoe.

Between the outside layers, the tongue of this invention also has an intermediate layer 5, for example in the form of a small-mesh plastic net. As seen in FIG. 1, this intermediate layer 5 appears in ventilation orifices 3 and 4 which are provided in the tongue.

When the tongue is assembled, preferably by heat-welding, front layer 1 and back layer 2 are caused to adhere around the periphery of the tongue (6) and at the level of each of the orifices where the material of the front layer, for example, passes through the mesh openings in intermediate layer 5 in the vicinity of the circumference of the orifices and adheres to the material of the other layer, contributing to keeping the intermediate layer in place between the outside layers.

In this example, a continuous intermediate layer extending over the greater part of the tongue was used, but it is clear that, according to the invention, it is possible to use only fragments of porous or reticular material placed between the outside layers of the tongue only near the orifices. Similarly, the tongue described was formed of an assemblage of two layers, but this in no way limits the invention, and in the case of a single padded layer with orifices, a porous or reticular reinforcing material could according to the invention be fixed to the inside surface of this layer or embedded in this layer, over the whole layer or only near the orifices.

Although the invention has been described in relation to a particular mode of implementation, it is therefore obvious that it is in no way limited to this mode of implementation, and that numerous variations and modifications can be introduced to it within both its scope and its spirit.

I claim:

1. A padded tongue for a shoe, particularly for a sport shoe, comprising a front layer having a multiplicity of orifices passing therethrough, each of said orifices having a porous or reticular material therein.

2. A tongue for a shoe as recited in claim 1, comprising:

a back layer having orifices corresponding to the orifices in said front layer, and an intermediate layer of a porous or reticular material disposed between the front layer and the back layer, the back layer being adhered to the front layer along the periphery of the tongue and along the circumference of each of the orifices.

3. A tongue for a shoe as recited in claim 2, wherein the back layer is adhered to the front layer by heat-welding.

4. A tongue for a shoe as recited in claim 2, wherein the intermediate layer is a small mesh net.

5. A shoe having a padded tongue with a front layer having a multiplicity of orifices passing therethrough, each of said orifices having a porous or reticular material therein.

6. A shoe as recited in claim 5, wherein said shoe is a sport shoe.

7. A shoe as recited in claim 5 or 6, wherein said tongue is comprised of:

a back layer having orifices corresponding to the orifices in the front layer, and an intermediate layer of a porous or reticular material disposed between the front layer and back layer, the back layer being adhered to the front layer along the periphery of the tongue and along the circumference of each of the orifices.

8. A shoe as recited in claim 7, wherein the back layer is adhered to the front layer by heat-welding.

9. A shoe as recited in claim 7, wherein the intermediate layer is a small mesh net.

* * * * *